US005456026A

United States Patent [19]

Lewis

[11] Patent Number: 5,456,026

[45] Date of Patent: Oct. 10, 1995

[54] SHOE WITH INTERCHANGEABLE HEELS

[75] Inventor: Rosalie Lewis, Los Angeles, Calif.

[73] Assignee: Lewis International Importing/Exporting, Inc., Beverly Hills, Calif.

[21] Appl. No.: 155,516

[22] Filed: Nov. 22, 1993

[51] Int. Cl.[6] ..... A43B 21/36

[52] U.S. Cl. ..... 36/42; 36/36 R

[58] Field of Search ..... 36/36 R, 36 A, 36/36 B, 36 C, 41, 42, 34 R, 15, 132, 114, 100

[56] References Cited

U.S. PATENT DOCUMENTS

| | | | |
|---|---|---|---|
| 26,712 | 1/1860 | Shaw | 36/42 |
| 640,317 | 1/1900 | Perry | 36/42 |
| 879,011 | 2/1908 | Sedivi | 36/42 |
| 1,044,222 | 11/1912 | Mladezki et al. | 36/36 R |
| 1,215,080 | 2/1917 | Thomson | 36/42 |
| 2,233,250 | 2/1941 | Easton | 36/42 |
| 2,795,866 | 6/1957 | Perugia . | |
| 3,064,367 | 11/1962 | Henatsch . | |
| 3,077,680 | 2/1963 | Moustakidis et al. . | |
| 3,432,945 | 3/1969 | Cesta . | |
| 3,754,340 | 8/1973 | Pais . | |
| 4,214,384 | 7/1980 | Gonzalez . | |
| 4,363,177 | 12/1982 | Boros . | |
| 4,670,996 | 6/1987 | Dill . | |
| 5,025,574 | 6/1991 | Lasher, III | 36/42 |
| 5,058,290 | 10/1991 | Koehl et al. . | |
| 5,079,857 | 1/1992 | Clifton . | |
| 5,133,138 | 7/1992 | Durcho . | |

*Primary Examiner*—Jimmy G. Foster
*Assistant Examiner*—Thomas P. Hilliard
*Attorney, Agent, or Firm*—Thomas I. Rozsa; Tony D. Chen

[57] ABSTRACT

The present invention is a shoe with an interchangeable heel. It comprises a latch member mounted to the bottom surface of the heel portion of the outsole of the shoe, and a frame member mounted to the top surface of the heel within a recess thereof. The latch member includes a wedge and a leaf-spring attached to the wedge. The leaf-spring has a stepped detent and a lever biased by a spring tension away from the wedge. The frame member has a wedge shaped slot for receiving the wedge of the latch member in a dove-tail connection, and an internal cavity connected to the wedge shaped slot for housing the leaf-spring of the latch member and having a front crossbar.

19 Claims, 2 Drawing Sheets

FIG. 5
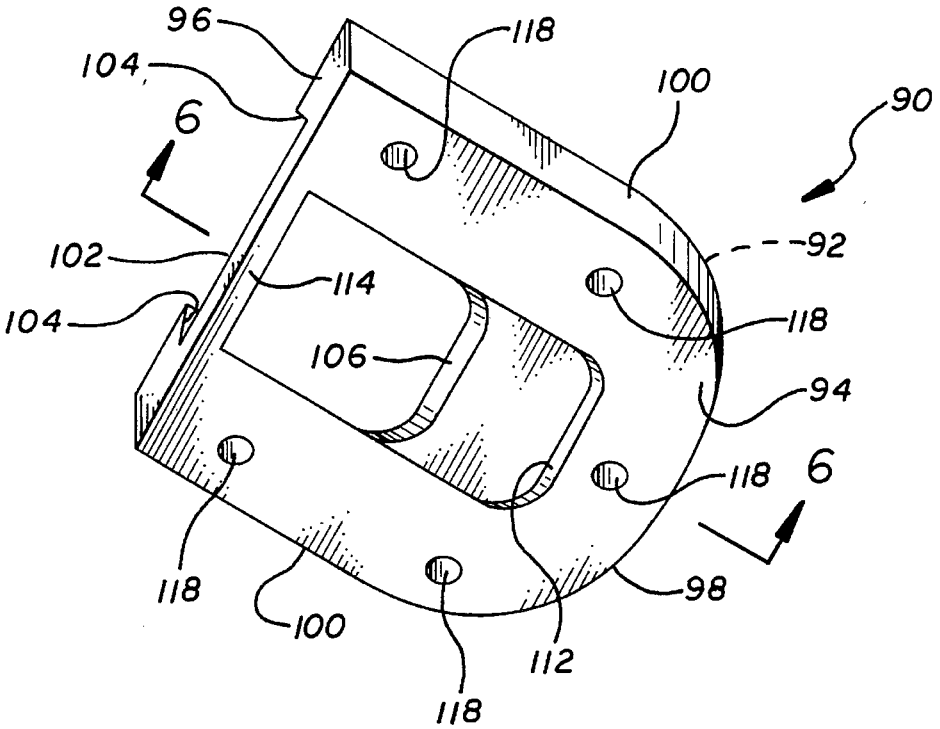
FIG. 6
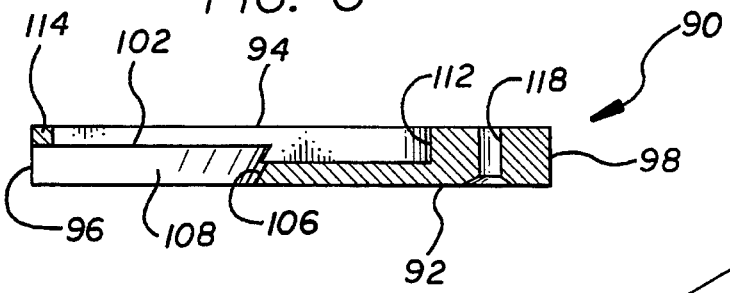
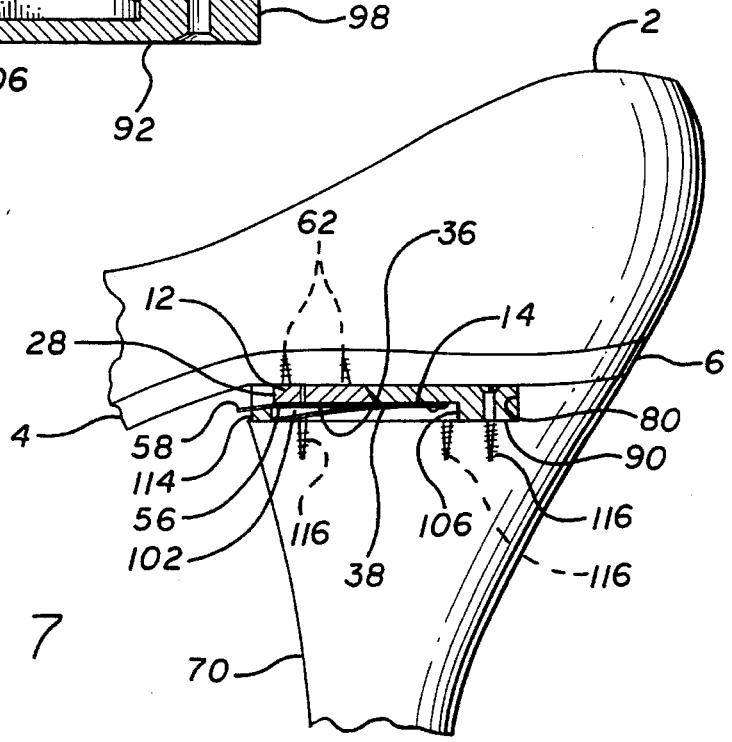
FIG. 7

SHOE WITH INTERCHANGEABLE HEELS

BACKGROUND OF THE INVENTION

1. Field of the Invention

The present invention relates to the field of design and construction of shoes. More particularly the present invention relates to the field of design and construction of interchangeable heels for shoes.

2. Description of the Prior Art

The heels of shoes, particularly the high heels of women's shoes, are extremely fragile and can be damaged easily. When the heel is damaged, it is often very expensive to have it repaired. In addition, it is strenuous to walk long distances in high heels. Many businesswomen prefer to have flat or low-heeled shoes for walking and then wear the high heel shoes during work. At present, this requires the women to have two sets of shoes; a pair of low heel shoes for walking and a pair of high heel shoes for wear during work. Making the heels interchangeable is one way to solve this problem. The following eleven (11) prior art patents are related to the design and construction of interchangeable heels.

1. U.S. Pat. No. 2,795,866 issued to Perugia on Jun. 18, 1957 for "Ladies' Shoes" (hereafter "the Perugia Patent").
2. U.S. Pat. No. 3,064,367 issued to Henatsch on Nov. 20, 1962 for "Replacement Heel Structure" (hereafter "the Henatsch Patent").
3. U.S. Pat. No. 3,077,680 issued to Moustakidis el al. on Feb. 19, 1963 for "Removable Shoe Heel" (hereafter "the Moustakidis Patent").
4. U.S. Pat. No. 3,432,945 issued to Cesta on Mar. 18, 1969 for "Replaceable Heels For Shoes" (hereafter "the Cesta Patent").
5. U.S. Pat. No. 3,754,340 issued to Pais on Aug. 28, 1973 for "Devices For Attaching Heels To Shoe Soles" (hereafter "the Pais Patent").
6. U.S. Pat. No. 4,214,384 issued to Gonzalez on Jul. 29, 1980 for "Replaceable Heel Construction For Shoes" (hereafter "the Gonzalez Patent").
7. U.S. Pat. No. 4,363,177 issued to Boros on Dec. 14, 1982 for "Style Convertible Footwear" (hereafter "the Boros Patent").
8. U.S. Pat. No. 4,670,996 issued to Dill on Jun. 9, 1987 for "Women's Shoes With Flexible Spring Steel Shanks For Use With Replaceable Heels Of Different Height" (hereafter "the Dill Patent").
9. U.S. Pat. No. 5,058,290 issued to Koehl et al. on Oct. 22, 1991 for "Shoe Construction With Self Seating Removable Heel" (hereafter "the Koehl Patent").
10. U.S. Pat. No. 5,079,857 issued to Clifton on Jan. 14, 1992 for "Shoe Having A Detachable Heel" (hereafter "the Clifton Patent").
11. U.S. Pat. No. 5,133,138 issued to Durcho on Jul. 28, 1992 for "Replaceable High Heel" (hereafter "the Durcho Patent").

The Perugia Patent discloses a ladies' shoe having a replaceable heel. The heel is provided with a metal tenon curved along a circular arc in the direction of its length. The insole of the shoe is a mortise slide which is curved with the same radius of curvature as the tenon and the inside section of which corresponds to that of the tenon. To mount the heel to the shoe, the tenon engages in the mortise slide and is pushed until the heel comes against the extreme edge of the sole. To disengage the heel from the shoe, the heel is pulled towards the outside. The Perugia Patent also teaches an assortment of heels of different shapes, styles and colors.

The Henatsch Patent discloses a replaceable heel structure. The heel consists of two portions. The first portion is a tread-retaining portion which is attached to the bottom of the sole, and the second portion is the tread portion which is slidably attached to the tread-retaining portion. The Henatsch Patent is designed with a flat heel.

The Moustakidis Patent discloses a removable shoe heel. The heel assembly is permanently attached to the base plate of the shoe.

The Cesta Patent discloses a replaceable heel construction for shoes. The heel base carries a latch plate with rear and front openings having marginal tongues, the rear tongues being inclined and providing fulcrums and guides and the front tongues being upright and providing guides.

The Pais Patent discloses an apparatus for coupling a shoe heel to a shoe. It includes an elongated plate used as a shank which extends up to and adjacent the sole back end.

The Gonzalez Patent discloses a replaceable heel construction for shoes. A coupling element 20 is positioned to receive wings 12 of a coupling element 10. Upon full insertion of the wings 12 in the slot of the coupling element 20, flanges 21 will underlay the wings, the slot conforms to the configuration of the wings, and a resilient locking tab 23 will snap-down into locking groove 13.

The Boros Patent discloses convertible footwear. A detachably attachable heel is secured adjacent the heel portion of the sole by lock means which include a threaded stud for threadedly engaging a cavity within the sole.

The Dill Patent discloses a woman's shoe with flexible shank for use with replaceable heels of different sizes. It includes an elongated flexible spring steel shank which is nestled within a slot between the insole and sole and anchored at one end. A high heel registers with the heel portion and interlocking fasteners. Upon limited rotation of the heel relative to the shoe, it removably anchors the heel upon the shoe. The heel upon limited angular rotation and disengagement of the fasteners is adapted for removal and replacement by a low heel having similar fasteners. The shank moves within the slot to compensate for the change in height. The interlocking fasteners include opposed interconnected lock segments and anchor flanges secured to the heel and heel portion respectively. An alignment pin in the heel projects into an alignment opening in the sole preventing relative rotation of the heel and heel portion to prevent disengagement of the segments and flanges.

The Koehl Patent discloses a shoe construction with a self-seating removable heel. A high heel is removably attached to the shoe and has an enlarged upper end portion with an inclined upper surface carrying a dovetail locking member that extends upwardly from the high heel upper end portion inclined surface. The locking member includes a pedestal with a dove-tail sidewall that corresponds to and registers with the socket so that the heel can be attached to the socket by moving the heel pedestal into the socket in a fore to aft direction. The pedestal and socket are thus loaded during normal use of the shoe, so that during walking, the heel pedestal is continuously forced rearwardly into the socket.

The Clifton Patent discloses a shoe having a detachable heel. The shoe includes a foot receptacle portion having a threaded stem extending downwardly from a heel plate fixedly attached to the bottom of the foot receptacle portion which selectively receives a shoe heel in threaded engagement. A spring-biased locking pin is disposed in the shoe heel which engages a locking pin slot formed in the heel plate of the foot receptacle portion.

The Durcho Patent discloses a replaceable high heel. The device is an improved shoe which includes a shoe having an upper and a sole, a block extending downwardly from the lower portion of the sole adjacent to the heel, and a magnetic plate facing downwardly from the block. An improved replaceable heel includes an upper surface with an upwardly facing recess and a magnetically responsive plate which faces upwardly on the lower surface of the recess.

One of the problems of the prior art interchangeable heels is that they often have very complicated structures. This often increases the manufacturing costs and therefore the price of the shoes. Another problem of the prior art interchangeable heels is that they are often hard to handle, some even requiring a tool to detach the heel. A further problem of the prior art interchangeable heels is that they are not durable. In most prior art design and constructions, the mating members between the outsole and the heel are part of the structure of the heel or the outsole of the shoe. Therefore the strength and durability of the mating members are limited by the properties of the materials used for the construction of the heel or the outsole of the shoe.

It is desirable to design and construct shoes with interchangeable heels which are easy to handle, durable and inexpensive to manufacture.

SUMMARY OF THE INVENTION

The present invention is a shoe with an interchangeable heel.

It is known that the heel of a shoe, particularly the high heel of a woman's shoe, is the part that most easily becomes damaged, and repairing a shoe with a damaged heel is often very expensive. Therefore, shoes with interchangeable high heels have been developed. With an interchangeable high heel, if the heel is damaged, then the heel can be simply replaced with a new heel, and the shoe can be worn again.

It is further known that it is more comfortable for a woman to walk in flat or low-heeled shoes rather than high heels. For working women who need to wear high heels with a business suit or dress during work, and who also have to walk a long distance from their car or public transportation to their place of work, this frequently necessitates carrying two pairs of shoes; low-heeled or flat shoes to walk and high heeled shoes to wear during work. By having interchangeable heels, the low or flat-heeled shoes could be worn during the long walk and then an interchangeable high heel could be worn during work. In this way, the same shoe can be used and it eliminates the necessity of carrying an extra pair of shoes.

It has been discovered, according to the present invention, that if the attachment between the outsole of a shoe and the heel of the shoe is established through a mating assembly, then the outsole and heel can be made of normal materials such as those used for conventional shoes, while the mating assembly can be made of strong materials which can withstand the stress and impact at the conjunction of the outsole and the heel.

It has also been discovered, according to the present invention, that if the mating assembly for interchangeably attaching a heel to the outsole of a shoe includes a latch member which can be permanently mounted to the outsole of a shoe, and a frame member which can be permanently mounted to the interchangeable heel, then the heel can be readily attached to the outsole without pre-attachment.

It has further been discovered, according to the present invention, that if the frame member of the mating assembly has a U-shaped slot with beveled side rails, and the latch member of the mating assembly has a U-shape wedge with beveled sidewalls, then the latch member and the frame member can engage in a dove-tail connection which prevents the separation along the vertical direction and the rotation between the outsole and the heel.

It has additionally been discovered, according to the present invention, that if the latch member has a wedged leaf-spring with a stepped detent, and the frame member has a cavity with a crossbar at its front end, then when the latch member and the frame member engage in a dove-tail connection, the wedged leaf-spring is retained within the cavity while the crossbar blocks the stepped detent of the leaf-spring which prevents separation of the outsole and the heel along the horizonal or longitudinal direction.

It has also been discovered, according to the present invention, that if the leaf-spring of the latch member further has a lever which extends beyond the crossbar of the frame member and out of the front side of the heel, then the latch member can be removed from the frame member by simply pressing on the lever of the leaf-spring to disengage the stepped detent of the leaf-spring from the crossbar of the frame member.

It is therefore an object of the present invention to provide a shoe with an interchangeable heel, where the attachment between the outsole of a shoe and the heel of the shoe is established through a mating assembly, so that the outsole and heel can be made of normal materials as used for conventional shoes, while the mating assembly can be made of strong materials which can withstand the stress and impact at the juncture of the outsole and the heel.

It is also an object of the present invention to provide a shoe with an interchangeable heel, where the mating assembly for interchangeably attaching a heel to the outsole of a shoe includes a latch member which can be permanently mounted to the outsole of a shoe, and a frame member which can be permanently mounted to the interchangeable heel, so that the heel can be readily attached to the outsole without pre-attachment.

It is a further object of the present invention to provide a shoe with an interchangeable heel, where the frame member of the mating assembly has a U-shaped slot with beveled side rails, and the latch member of the mating assembly has a U-shaped wedge with beveled sidewalls, so that the latch member and the frame member can engage in a dove-tail connection which prevents the separation along the vertical direction and the rotation between the outsole and the heel.

It is an additional object of the present invention to provide a shoe with an interchangeable heel, where the latch member has a wedged leaf-spring with a stepped detent, and the frame member has a cavity with a crossbar at its front end, so that when the latch member and the frame member engage in a dove-tail connection, the wedged leaf-spring is retained within the cavity while the crossbar blocks the stepped detent of the leaf-spring which prevents separation of the outsole and the heel along the horizonal or longitudinal direction.

It is still a further object of the present invention to provide a shoe with an interchangeable heel, where the leaf-spring of the latch member further has a lever which extends beyond the crossbar of the frame member and out of the front side of the heel, so that the latch member can be removed from the frame member by simply pressing on the lever of the leaf-spring to disengage the stepped detent of the leaf-spring from the crossbar of the frame member.

Described generally, the present invention is a shoe with an interchangeable heel. The shoe has an outsole having a heel portion with a bottom surface, and a heel having a top surface and a front side, the top surface having a recess extending to the front side. The heel is interchangeably attached to the outsole by a mating assembly which includes a latch member and a frame member.

The latch member includes a wedge and a leaf-spring attached to the wedge. The wedge has a front notch and two beveled lateral rails, and the leaf-spring has a stepped detent and a lever biased by a spring tension away from wedge. The latch member is mounted to the heel portion of the outsole, such that the top surface of the wedge of the latch member is brought into contact with the bottom surface of the heel portion of the outsole.

The frame member has a wedge shaped slot and an internal cavity. The wedge shaped slot has two beveled lateral channels for receiving the wedge of the latch member in a dove-tail connection. The internal cavity is connected to the wedge shaped slot for housing the leaf-spring of the latch member and has a front crossbar. The frame member is mounted to the top surface of the heel within the recess thereof, such that the frame member is flush with the top surface of the heel, and the front crossbar of the frame member is flush with the front side of the heel.

The heel can be interchangeably attached to the heel portion of the outsole by sliding the wedge of the latch member into the wedge shaped slot of the frame member such that the leaf-spring is situated inside the cavity of the frame member. As the stepped detent of the leaf-spring extends away from the wedge of the latch member, it engages with the front crossbar of the frame member which prevents the latch member from sliding out of the frame member, thereby securing the heel to the shoe.

The heel can also be interchangeably detached and replaced by pressing the lever of the leaf-spring of the latch member in a direction towards the outsole as allowed by the front notch of the wedge of the latch member, so that the stepped detent of the leaf-spring of the latch member is disengaged with the front crossbar of the frame member. The wedge of the latch member can then be slid out from the wedge shaped slot of the frame member to separate the heel and the shoe.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 5 is a perspective view of the frame member.

FIG. 6 is a cross-sectional view of the frame member taken along line 6—6 of FIG. 5.

FIG. 7 is a cross-sectional view of the shoe outsole and heel fastened together by the latch member and the frame member.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a shoe with interchangeable heel. The essential part of the present invention is a mating assembly which includes a latch member and a frame member. The latch member is mounted to the outsole of the sole, and the frame member is mounted to the heel.

Figure 1:
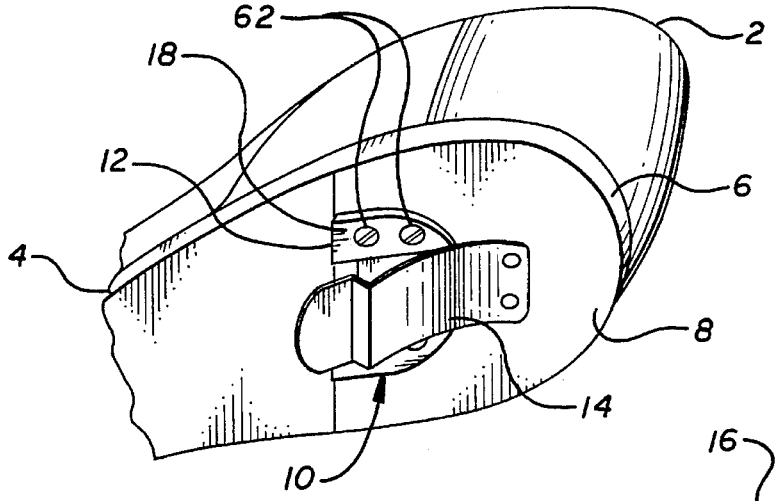
FIG. 1 is a perspective view of the latch member attached to the outsole.
Figure 4:
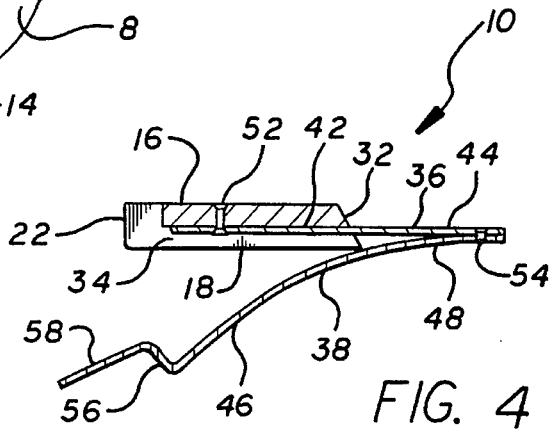
FIG. 4 is a cross-sectional view of the latch member taken along line 4—4 of FIG. 3.
Figure 3:
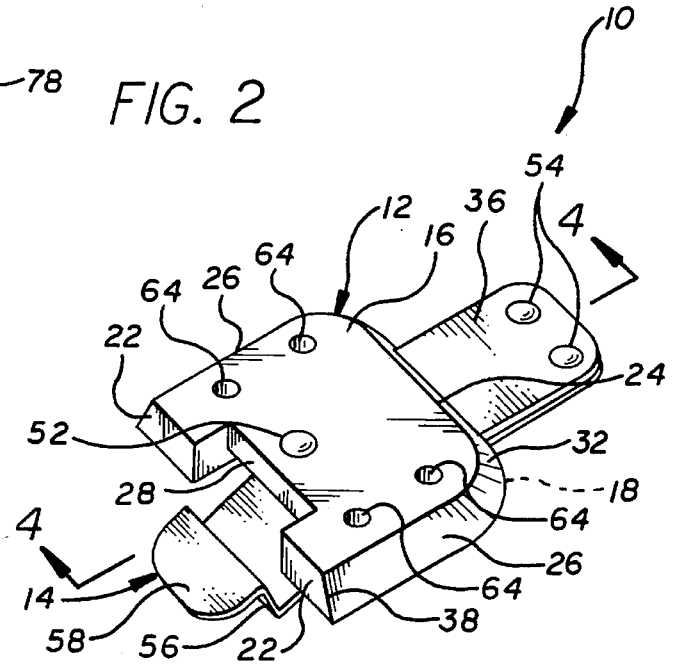
FIG. 3 is a perspective view of the latch member.

Referring to FIGS. 1, 3 and 4, there is shown a shoe 2 having an outsole 4. The outsole 4 has a heel portion 6 with a bottom surface 8. A latch member 10 is mounted to the bottom surface 8 of the heel portion 6 of the outsole 4. The latch member 10 includes a wedge 12 and a leaf-spring 14.

The wedge 12 of the latch member 10 has a top surface 16, a bottom surface 18, a front end 22, a rear end 24 and two lateral sides 26. The front end has a notch 28. The rear end and the two lateral sides form a U-shaped beveled sidewall 32, such that the bottom surface 18 is wider than the top surface 16. In addition, the bottom surface 18 has a shallow slot 34.

The wedge 12 of the latch member 10 is preferably made of plastic material. It may also be made of metal material or other suitable materials. By way of example only, the depth of the wedge 12 is ¾", the thickness is ⅛", the width of the top surface 16 is ⅞", the width of the bottom surface 18 is 1", and the depth of the notch is ⅛".

The leaf-spring 14 includes an upper segment 36 and a lower segment 38. The upper segment 36 has a front end portion 42 and a rear end portion 44, and the lower segment 38 also has a front end portion 46 and a rear end portion 48. The front end portion 42 of the upper segment 36 is attached to the bottom surface 18 of the wedge 12 within the shallow slot 34 thereof by a small dowel pin. The respective rear end portions 44 and 48 of the upper and lower segments 36 and 38 of the leaf-spring are coupled together by a pair of small dowel pins 54, such that the front end portion 46 of the lower segment 38 is biased by a spring tension away from the front end portion 42 of the upper segment 36, or in other words, away from the wedge 12. The front end portion 46 of the lower segment 38 forms a stepped detent 56 and a lever 58.

The leaf-spring 14 is preferably made of metal material. By way of example only, the length of the upper segment 36 of the leaf-spring is 1⅛", the total length of the lower segment is approximately 1⅝", where height of the stepped detent 56 is ⅛", and the length of the lever 58 is ⅜".

The latch member 10 is mounted to the heel portion 6 of the outsole 4 by a multiplicity of small nails 62 respectively hammered through a multiplicity of through holes 64 on the wedge 12 of the latch member 10. The top surface 16 of the wedge 12 is brought into contact with the bottom surface 8 of the heel portion 6 of the outsole 4.

Figure 2:
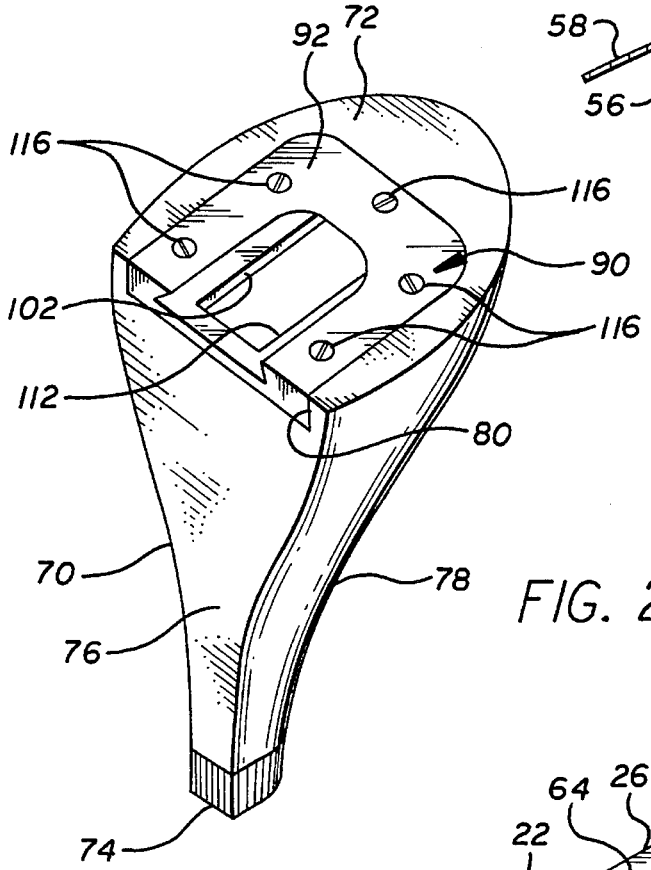
FIG. 2 is a perspective view of the frame member attached to the heel.

Referring to FIGS. 2, 5 and 6, there is shown at 70 an interchangeable heel to be attached to the heel portion 6 of the outsole 4 of the shoe 2. The interchangeable heel 70 has a top surface 72, a bottom tip 74, a front side 76 and a curved rear surface 78. The top surface 72 has a generally rectangular shaped recess 80 extending to the front side 76. The purpose of having the recess 80 is to retain the frame member 90 of the mating assembly.

The frame member 90 is generally rectangular shaped. It has a top surface 92, a bottom surface 94, a front end 96, a rear end 98 and two lateral sides 100. The frame member 90 has a wedge shaped slot 102 extending from the front end 96 and exposed to the top surface 92. The wedge shaped slot 102 has two beveled lateral channels 104, which are parallel to the two lateral sides 100 of the frame member 90, and a beveled rear edge 106. The two beveled lateral channels 104 and the beveled rear edge 106 together form a U-shaped beveled sidewall 108 which is engageable with the U-shaped beveled sidewall 32 of the wedge 12 of the latch member 10, such that the wedge shaped slot 102 receives the wedge 12 of the latch member 10 in a dove-tail connection.

The frame member 90 further has a cavity 112 exposed to the bottom surface 94 and connected to the wedge shaped slot 102. The cavity 112 is designed for housing the leaf-spring 14 of the latch member 10. The front end 96 of the frame member has a crossbar 114.

The frame member 90 is preferably made of plastic material. It may also be made of metal material or other suitable materials. By way of example only, the width of the frame member 90 is 1½", the depth is 1⅝", and the height is 3/16". The dimensions of the wedge shaped slot 102 matches those of the wedge 12 of the latch member 10.

The frame member 90 is mounted to the top surface 72 of the heel 70 within the recess 80 thereof by a multiplicity of small nails 116 respectively hammered through a multiplicity of through holes 118 on the frame member 90. The top surface 92 of the frame member 90 is flush with the top surface 72 of the heel 70, and the front end 96 of the frame member 90 is flush with the front side 76 of the heel 70.

Referring to FIG. 7, the heel 70 can be interchangeably attached to the heel portion 6 of the outsole 4 by sliding the wedge 12 of the latch member 10 into the wedge shaped slot 102 of the frame member 90. The leaf-spring 14 is situated inside the cavity 112 of the frame member 90. As the lower segment 38 of the leaf-spring 14 extends away from the upper segment 36 of the leaf-spring 14, the stepped detent 56 engages with the crossbar 114 of the frame member 90, which prevents the latch member 10 from sliding out of the frame member 90, thereby securing the heel 70 to the shoe 2.

The heel 70 can also be interchangeably detached and replaced by pressing the lever 58 of the leaf-spring 14 of the latch member 10 in a direction towards the outsole 4, as allowed by the clearance created by the notch 28 of the wedge 12 of the latch member 10, so that the stepped detent 56 of the leaf-spring 14 of the latch member 10 is disengaged with the crossbar 114 of the frame member 90. Once the stepped detent 56 is disengaged with the crossbar 114, the wedge 12 of the latch member 10 can be slid out from the wedge shaped slot 102 of the frame member 90, to thereby separate the heel 70 and the shoe 2. A user can use one hand to hold the middle portion of the shoe, use the thumb of that hand to press the lever 58 of the leaf-spring 14 towards the outsole 4, and then use the other hand to hold the heel 70 and pull it in a direction away from the first hand.

The present invention has many advantageous features, including: (a) it utilizes a mating assembly to establish the attachment between the outsole of a shoe and the heel of the shoe, so that the outsole and heel can be made of normal materials as used for conventional shoes, while the mating assembly can be made of strong materials which can withstand the stress and impact at the juncture of the outsole and the heel; (b) it utilizes a latch member which can be permanently mounted to the outsole of a shoe, and a frame member which can be permanently mounted to the interchangeable heel, so that the heel can be readily attached to the outsole without pre-attachment; (c) it utilizes a frame member having a U-shaped slot with beveled side rails, and a latch member having a U-shape wedge with beveled sidewalls, so that the latch member and the frame member can engage in a dove-tail connection which prevents the separation along the vertical direction and the rotation between the outsole and the heel; (d) it utilizes a latch member having a wedged leaf-spring with a stepped detent, and a frame member having a cavity with a crossbar at its front end, so that when the latch member and the frame member engage in a dove-tail connection, the wedged leaf-spring is retained within the cavity while the crossbar blocks the stepped detent of the leaf-spring which prevents separation of the outsole and the heel along the horizonal or longitudinal direction; and (e) it utilizes a leaf-spring which has a lever extending beyond the crossbar of the frame member and out of the front side of the heel, so that the latch member can be removed from the frame member by simply pressing on the lever of the leaf-spring to disengage the stepped detent of the leaf-spring from the crossbar of the frame member.

In the figures, a high heel is depicted. It will be appreciated that a frame member 90 can be attached to several different heels to be worn with the same shoe, such as a flat heel, a medium heel and a high heel. The interchangeable feature therefore permits the same shoe to be worn with many different heels for different uses. Also, the frame member 90 can be attached to two identical heels so that one can replace the other if the first one is broken.

Defined in detail, the present invention is a shoe with an interchangeable heel, comprising: (a) an outsole having a heel portion with a bottom surface; (b) a heel having a top surface and a front side, the top surface having a generally rectangular shaped recess extending to the front side; (c) a latch member including a wedge and a leaf-spring; (d) the wedge of the latch member having a top surface, a bottom surface, a front end, a rear end and two lateral sides, the front end having a notch, the rear end and the two lateral sides forming a U-shaped beveled sidewall such that the bottom surface is wider than the top surface, and the bottom surface having a shallow slot; (e) the leaf-spring having an upper segment and a lower segment each having a front end portion and a rear end portion, the front end portion of the lower segment forming a stepped detent and a lever; (f) means for attaching the front end portion of the upper segment of the leaf-spring to the bottom surface of the wedge within the shallow slot thereof; (g) means for coupling the rear end portions of the upper and lower segments of the leaf-spring together such that the front end portion of the lower segment is biased by a spring tension away from the front end portion of the upper segment; (h) means for mounting the latch member to the heel portion of the outsole, such that the top surface of the wedge of the latch member is brought into contact with the bottom surface of the heel portion of the outsole; (i) a generally rectangular shaped frame member having a top surface, a bottom surface, a front end, a rear end and two lateral sides, the frame member further having a wedge shaped slot extending from the front end and exposed on the top surface, and having two lateral channels and a rear edge forming a U-shaped beveled sidewall engageable with the U-shaped beveled sidewall of the wedge of the latch member such that the wedge shaped slot receives the wedge of the latch member in a dove-tail connection, the frame member further having a cavity exposed to the bottom surface and connected to the wedge shaped slot for housing the leaf-spring of the latch member, and the front end having a crossbar; and (j) means for mounting the frame member to the top surface of the heel within the recess thereof, such that the top surface of the frame member is flush with the top surface of the heel, and the front end of the frame member is flush with the front side of the heel; (k) whereby the heel can be interchangeably attached to the heel portion of the outsole by sliding the wedge of the latch member into the wedge shaped slot of the frame member such that the leaf-spring is situated inside the cavity of the frame member, and as the lower segment of the leaf-spring extends away from the upper segment of the leaf-spring, the stepped detent engages with the crossbar at the front end of the frame member which prevents the latch member from sliding out of the frame member, thereby securing the heel to the shoe, and the heel can be interchangeably detached and replaced by pressing the lever of the leaf-spring of the latch member in a direction towards the outsole as allowed by the notch at the front end of the wedge of the latch member so that the stepped detent of the leaf-spring of the latch member is disengaged with the crossbar of the frame member, and sliding the wedge of the latch member out from the wedge shaped slot of the frame member to separate the heel and the shoe.

Defined broadly, the present invention is a shoe with an interchangeable heel, comprising: (a) an outsole having a heel portion with a bottom surface; (b) a heel having a top surface and a front side, the top surface having a recess extending to the front side; (c) a latch member including a wedge and a leaf-spring attached to the wedge, the wedge having a front notch and two beveled lateral rails, and the leaf-spring having a stepped detent and a lever biased by a spring tension away from wedge; (d) means for mounting the latch member to the heel portion of the outsole, such that the top surface of the wedge of the latch member is brought into contact with the bottom surface of the heel portion of the outsole; (e) a frame member having a wedge shaped slot and an internal cavity, the wedge shaped slot having two beveled lateral channels for receiving the wedge of the latch member in a dove-tail connection, and the internal cavity connected to the wedge shaped slot for housing the leaf-spring of the latch member and having a front crossbar; and (f) means for mounting the frame member to the top surface of the heel within the recess thereof, such that the frame member is flush with the top surface of the heel, and the front crossbar of the frame member is flush with the front side of the heel; (g) whereby the heel can be interchangeably attached to the heel portion of said outsole by sliding the wedge of the latch member into the wedge shaped slot of the frame member such that the leaf-spring is situated inside the cavity of the frame member, and as the stepped detent of the leaf-spring extends away from the wedge of the latch member, it engages with the front crossbar of the frame member which prevents the latch member from sliding out of the frame member, thereby securing the heel to the shoe, and the heel can be interchangeably detached and replaced by pressing the lever of the leaf-spring of the latch member in a direction towards the outsole as allowed by the front notch of the wedge of the latch member so that the stepped detent of the leaf-spring of the latch member is disengaged with the front crossbar of the frame member, and sliding the wedge of the latch member out from the wedge shaped slot of the frame member to separate the heel and the shoe.

Defined more broadly, the present invention is a shoe with an interchangeable heel, comprising: (a) an outsole having a heel portion with a bottom surface; (b) a heel having a top surface and a front side, the top surface having a recess extending to the front side; (c) a latch member mounted to the bottom surface of the heel portion of the outsole, the latch member including a latch and a leaf-spring attached to the latch, the leaf-spring having a stepped detent and a lever biased by a spring tension away from the latch; and (d) a frame member mounted to the top surface of the heel within the recess thereof, the frame member having a slot for receiving the latch of the latch member, and an internal cavity connected to the slot for housing the leaf-spring of the latch member and having a front crossbar; (e) whereby the heel can be interchangeably attached to the heel portion of the outsole by sliding the latch of the latch member into the slot of the frame member such that the leaf-spring is situated inside the cavity of the frame member, and as the stepped detent of the leaf-spring extends away from the latch of the latch member, it engages with the front crossbar of the frame member which prevents the latch member from sliding out of the frame member, thereby securing the heel to the shoe, and the heel can be interchangeably detached and replaced by pressing the lever of the leaf-spring of the latch member in a direction towards the outsole so that the stepped detent of the leaf-spring of the latch member is disengaged with the front crossbar of the frame member, and sliding the latch of the latch member out from the slot of the frame member to separate the heel and the shoe.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A shoe with an interchangeable heel, comprising:

a. an outsole having a heel portion with a bottom surface;

b. a heel having a top surface and a front side, the top surface having a generally rectangular shaped recess extending to the front side;

c. a latch member including a wedge and a leaf-spring;

d. said wedge of said latch member having a top surface, a bottom surface, a front end, a rear end and two lateral sides, the front end having a notch, the rear end and the two lateral sides forming a U-shaped beveled sidewall of said wedge such that the bottom surface of said wedge is wider than the top surface of said wedge, and the bottom surface of said wedge having a shallow slot;

e. said leaf-spring having an upper segment and a lower segment each having a front end portion and a rear end portion, the front end portion of the lower segment forming a stepped detent and a lever;

f. means for attaching said front end portion of the upper segment of said leaf-spring to said bottom surface of said wedge within said shallow slot thereof;

g. means for coupling said rear end portions of said upper and lower segments of said leaf-spring together such that said front end portion of said lower segment is biased by a spring tension away from said front end portion of said upper segment;

h. means for mounting said latch member to said heel portion of said outsole, such that said top surface of said wedge of said latch member is brought into contact with said bottom surface of said heel portion of said outsole;

i. a generally rectangular shaped frame member having a top surface, a bottom surface, a front end, a rear end and two lateral sides, the frame member further having a wedge shaped slot extending from the front end of the frame member and exposed on the top surface of the frame member, and having two lateral channels and a rear edge forming a U-shaped beveled sidewall of the frame member engageable with said U-shaped beveled sidewall of said wedge of said latch member such that the wedge shaped slot receives said wedge of said latch member in a dove-tail connection, the frame member further having a cavity exposed to the bottom surface of the frame member and connected to the wedge shaped slot for housing said leaf-spring of said latch member, and the front end of the frame member having a crossbar; and j. means for mounting said frame member to said top surface of said heel within said recess thereof, such that said top surface of said frame member is flush with said top surface of said heel, and said front end of said frame member is flush with said front side of said heel;

k. whereby said heel can be interchangeably attached to said heel portion of said outsole by sliding said wedge of said latch member into said wedge shaped slot of said frame member such that said leaf-spring is situated inside said cavity of said frame member, and as said lower segment of said leaf-spring extends away from said upper segment of said leaf-spring, said stepped detent engages with said crossbar at said front end of said frame member which prevents said latch member from sliding out of said frame member, thereby securing said heel to said shoe, and said heel can be interchangeably detached and replaced by pressing said lever of said leaf-spring of said latch member in a direction towards said outsole as allowed by said notch at said front end of said wedge of said latch member so that said stepped detent of said leaf-spring of said latch member is disengaged with said crossbar of said frame member, and sliding said wedge of said latch member out from said wedge shaped slot of said frame member to separate said heel and said shoe.

2. The invention as defined in claim 1 wherein said means for attaching said front end portion of the upper segment of said leaf-spring to said bottom surface of said wedge within said shallow slot thereof includes a small dowel pin.

3. The invention as defined in claim 1 wherein said means for coupling said rear end portions of said upper and lower segments of said leaf-spring together includes at least one small dowel pin.

4. The invention as defined in claim 1 wherein said means for mounting said latch member to said heel portion of said outsole includes a multiplicity of small nails respectively hammered through a multiplicity of through holes on said wedge of said latch member.

5. The invention as defined in claim 1 wherein said means for mounting said frame member to said top surface of said heel within said recess thereof includes a multiplicity of small nails respectively hammered through a multiplicity of through holes on said frame member.

6. The invention as defined in claim 1 wherein said wedge of said latch member is made of a plastic material.

7. The invention as defined in claim 1 wherein said leaf-spring of said latch member is made of a metal material.

8. The invention as defined in claim 1 wherein said frame member is made of a plastic material.

9. A shoe with an interchangeable heel, comprising:

a. an outsole having a heel portion with a bottom surface;

b. a heel having a top surface and a front side, the top surface having a recess extending to the front side;

c. a latch member including a wedge and a leaf-spring attached to the wedge, the wedge having a front notch and two beveled lateral rails, and the leaf-spring having a stepped detent and a lever biased by a spring tension away from wedge;

d. said leaf-spring further having an upper segment and a lower segment, each segment having a front end portion and a rear end portion, where the front end portion of the lower segment forms said stepped detent and said lever;

e. means for mounting said latch member to said heel portion of said outsole, such that said top surface of said wedge of said latch member is brought into contact with said bottom surface of said heel portion of said outsole;

f. a frame member having a wedge shaped slot and an internal cavity, the wedge shaped slot having two beveled lateral channels for receiving said wedge of said latch member in a dove-tail connection, and the internal cavity connected to the wedge shaped slot for housing said leaf-spring of said latch member and having a front crossbar; and g. means for mounting said frame member to said top surface of said heel within said recess thereof, such that said frame member is flush with said top surface of said heel, and said front crossbar of said frame member is flush with said front side of said heel;

h. whereby said heel can be interchangeably attached to said heel portion of said outsole by sliding said wedge of said latch member into said wedge shaped slot of said frame member such that said leaf-spring is situated inside said cavity of said frame member, and as said stepped detent of said leaf-spring extends away from said wedge of said latch member, said stepped detent of said leaf-spring engages with said front crossbar of said frame member which prevents said latch member from sliding out of said frame member, thereby securing said heel to said shoe, and said heel can be interchangeably detached and replaced by pressing said lever of said leaf-spring of said latch member in a direction towards said outsole as allowed by said front notch of said wedge of said latch member so that said stepped detent of said leaf-spring of said latch member is disengaged with said front crossbar of said frame member, and sliding said wedge of said latch member out from said wedge shaped slot of said frame member to separate said heel and said shoe.

10. The invention as defined in claim 9 wherein said means for mounting said latch member to said heel portion of said outsole includes a multiplicity of small nails respectively hammered through a multiplicity of through holes on said wedge of said latch member.

11. The invention as defined in claim 9 wherein said means for mounting said frame member to said top surface of said heel within said recess thereof includes a multiplicity of small nails respectively hammered through a multiplicity of through holes on said frame member.

12. The invention as defined in claim 9 wherein said front end portion of the upper segment of said leaf-spring is attached to said wedge by a small dowel pin.

13. The invention as defined in claim 9 wherein said rear end portions of said upper and lower segments of said leaf-spring are coupled together by at least one small dowel pin.

14. The invention as defined in claim 9 wherein said wedge of said latch member is made of a plastic material.

15. The invention as defined in claim 9 wherein said leaf-spring of said latch member is made of a metal material.

16. The invention as defined in claim 9 wherein said frame member is made of a plastic material.

17. A shoe with an interchangeable heel, comprising:

a. an outsole having a heel portion with a bottom surface;

b. a heel having a top surface and a front side, the top surface having a recess extending to the front side;

c. a latch member mounted to said bottom surface of said heel portion of said outsole, the latch member including a latch and a leaf-spring attached to the latch, the leaf-spring having a stepped detent and a lever biased by a spring tension away from the latch, the leaf-spring further having an upper segment and a lower segment each having a front end portion and a rear end portion, the front end portion of the upper segment being attached to the latch of the latch member, the rear end portions of the upper and lower segments being coupled together, and the front end portion of the lower segment forming the stepped detent and the lever; and d. a frame member mounted to said top surface of said heel within said recess thereof, the frame member having a slot for receiving said latch of said latch member, and an internal cavity connected to the slot for housing said leaf-spring of said latch member and having a front crossbar;

e. whereby said heel can be interchangeably attached to said heel portion of said outsole by sliding said latch of said latch member into said slot of said frame member such that said leaf-spring is situated inside said cavity of said frame member, and as said stepped detent of said leaf-spring extends away from said latch of said latch member, said stepped detent of said leaf-spring engages with said front crossbar of said frame member which prevents said latch member from sliding out of said frame member, thereby securing said heel to said shoe, and said heel can be interchangeably detached and replaced by pressing said lever of said leaf-spring of said latch member in a direction towards said outsole so that said stepped detent of said leaf-spring of said latch member is disengaged with said front crossbar of said frame member, and sliding said latch of said latch member out from said slot of said frame member to separate said heel and said shoe.

18. The invention as defined in claim 17 wherein said latch member is mounted to said heel portion of said outsole by a multiplicity of small nails respectively hammered through a multiplicity of through holes on said latch of said latch member.

19. The invention as defined in claim 17 wherein said frame member is mounted to said top surface of said heel within said recess thereof by a multiplicity of small nails respectively hammered through a multiplicity of through holes on said frame member.

* * * * *